United States Patent [19]

Monacelli

[11] Patent Number: 4,614,291

[45] Date of Patent: Sep. 30, 1986

[54] REINFORCED MAGAZINE FOR GUIDING FASTENERS

[76] Inventor: Umberto Monacelli, Via Milazzo 1, 20 552 Monza, Italy

[21] Appl. No.: 676,993

[22] Filed: Nov. 30, 1984

[30] Foreign Application Priority Data

Dec. 2, 1983 [GB] United Kingdom ..... 8332273

[51] Int. Cl.[4] ..... B25C 5/16

[52] U.S. Cl. ..... 227/120; 227/156; 206/340

[58] Field of Search ..... 227/120, 130, 131, 156, 227/132; 206/340, 341

[56] References Cited

U.S. PATENT DOCUMENTS

| | | | |
|---|---|---|---|
| 2,361,483 | 10/1944 | Lang | 227/132 |
| 3,612,380 | 10/1971 | Kuhlman | 227/120 |
| 3,640,443 | 2/1972 | Itagaki | 227/120 |
| 4,109,844 | 8/1978 | Becht | 227/120 |
| 4,119,258 | 10/1978 | Ewig, Jr. | 227/132 |
| 4,211,351 | 7/1980 | Monacelli | 227/120 |
| 4,326,661 | 4/1982 | Maurer et al. | 227/120 |
| 4,389,012 | 6/1983 | Grikis et al. | 227/156 X |

*Primary Examiner*—Robert L. Spruill
*Assistant Examiner*—Taylor J. Ross
*Attorney, Agent, or Firm*—Sughrue, Mion, Zinn, Macpeak, and Seas

[57] ABSTRACT

A guide bench, or magazine, for fastener elements. Formed mainly of plastics, a first metal portion is embedded to provide a surface of an ejection runway and a further metal portion is embedded to provide a retaining surface. If desired, the two metal portions can form integral parts of a single metal reinforcing member extending the length of the bench.

12 Claims, 14 Drawing Figures

REINFORCED MAGAZINE FOR GUIDING FASTENERS

The present invention relates to a guide bench for guiding fastener elements and to fastener driving apparatus having such a guide bench.

In a portable fastener driving tool used for driving fasteners such as staples, nails, tacks and the like, weight is of great concern. Material selection has played a major role in making the tool lighter such as defined in Monacelli U.S. Pat. No. 4,211,351.

In tools for driving fasteners arranged in a row-like array, a channel is used to guide the fasteners which are thrust forward by a slidable pusher into an ejection runway. The leading fastener is positioned in the runway under a driving punch ready to be driven into a workpiece. The channel, commonly known as a guide bench or magazine, is usually removable for loading fasteners and latchable in the tool by a retaining means which engages a surface at one end of the bench.

Portable tools of this nature are used in industry for a variety of applications that require speed and ease of handling. To satisfy this need it is best to make the tool as small and lightweight as possible. Since the tool is portable, it is also subject to being hit, dropped, and handled roughly in general, therefore it must be constructed to withstand this type of treatment.

In previous fastener driving apparatus, the bench is usually formed by sheet metal and steel shapes welded together with the front metal section forming a portion of the ejection runway. Although this construction is robust it is also objectionably heavy.

An object of the present invention is to provide an improved guide bench which is lightweight yet robust.

According to one aspect of the invention, there is provided a guide bench for guiding fastener elements to be driven along an ejection runway by fastener driving apparatus, the bench comprising a guide section for guiding fastener elements to said ejection runway and a retaining portion for contact by retaining means in said apparatus, characterised in that a major portion of the bench is of synthetic plastics material; first and second metal portions are embedded in said plastics material; a surface of said first metal portion is exposed and shaped to form a wall of said ejection runway; and a surface of said second metal portion forms said retaining portion.

According to a further aspect of the invention, there is provided fastener driving apparatus including the guide bench of said one aspect.

For a better understanding of the invention, and to show how the same may be carried into effect, reference will now be made, by way of example, to the accompanying drawings, in which.

Figure 1:
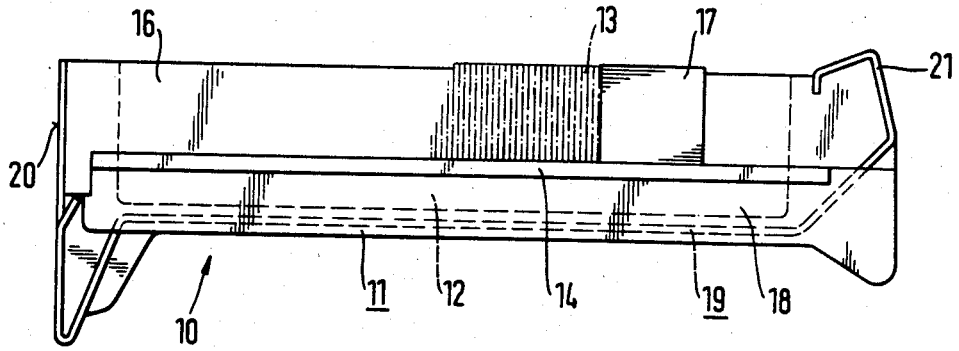
FIG. 1 is a side elevation view of a guide bench according to one embodiment of the present invention.

FIG. 1 shows a guide bench 10 suitable for insertion in a portable fastener driving tool having conventional mounting means. The bench has a base 11 with a channel-like portion 12 for supporting the fasteners 13 and web-like extensions 14 for slidably engaging a complementary guideway in the tool as indicated by dash lines 15 in FIG. 4.

The fasteners 13 are slidably supported by vertical ribs 16 extending from the base 11. A pusher 17 moves the array of fasteners 13 forwards into an ejection runway. The means for biasing the pusher 17 and driving means for ejecting the fasteners from the tool into a workpiece are wholly conventional The bench is retained in the tool by retaining means (not shown) such as a spring-loaded latch which engages retaining portion 21.

Figure 2A:
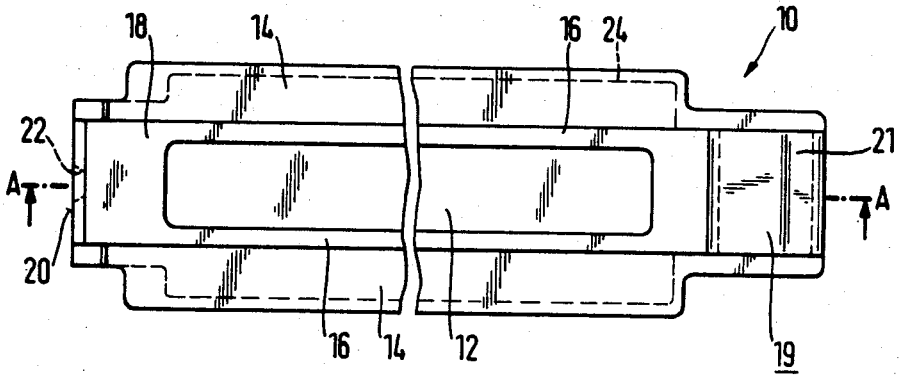
FIG. 2A is a plan view of the bench of FIG. 1 showing one type of reinforcement.
Figure 2B:
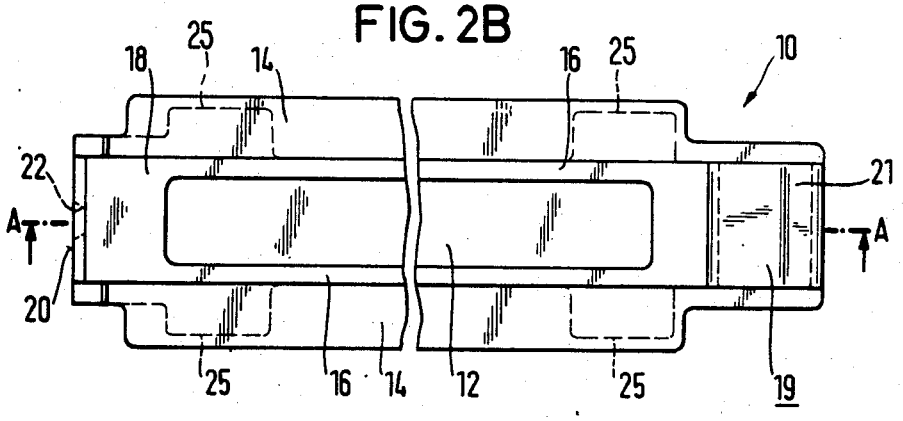
FIG. 2B is a plan view of the bench of FIG. 1 showing another type of reinforcement.
Figure 3:
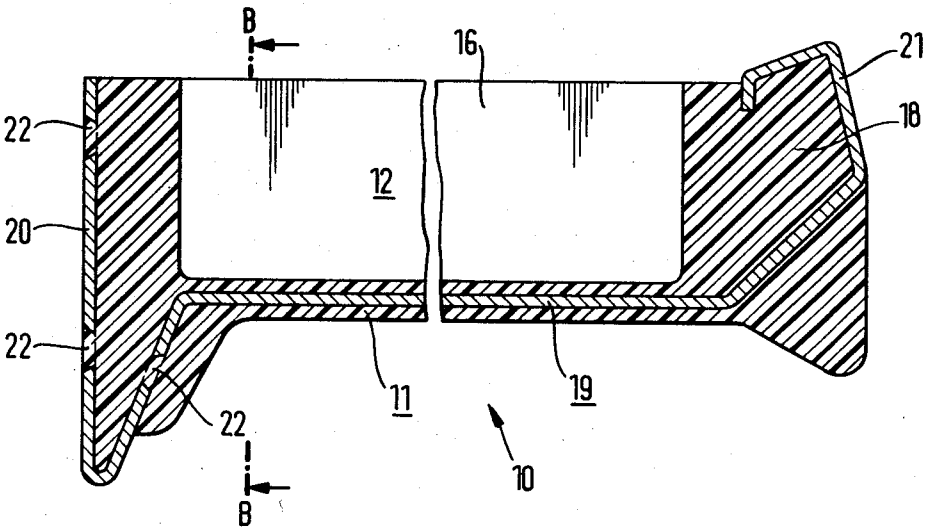
FIG. 3 is a sectional side elevation along line A—A of FIG. 2.

Referring now to FIGS. 2 and 3, a greater portion on the bench is made of plastics material indicated by 18 and a lesser portion is made from metal indicated by 19. Thus the bench is lighter than previous benches constructed completely from metal.

It will be apparent that the ejection runway is subject to high wear. Therefore, the metal member 19 is formed from a strip such as to have a first surface 20 forming a wall portion of the ejector runway when the bench is securely positioned in the fastener driving tool. The member 19 is bent upwardly and away from the lower edge of surface 20 and then transversely embedded in the base 11. A rearward portion is shaped to protrude from the plastics material such as to expose a second surface 21 adapted to be contacted by the bench retaining means.

Normally the area contacted by the bench retaining means is subject to high wear. The metal surface 21 resists such wear better than the plastics material. The configuration of the contact surface 21 shown in FIG. 3 is for one type of tool. It will be understood that, within the scope of this invention, the contact surface 21 may be adapted to the shape and/or configuration of other tools.

The length of the first surface 20 will depend on the type of tool in which the bench is to be used. A shorter surface 20 would be suitable for a configuration in which the metal member 19 bends transversely from the lower edge of surface 20 directly into the base without first being formed in a generally reverse bend as described above.

The surfaces 20 and 21 are shown as forming respective end portions of a through-going metal member, but in an alternative embodiment they are surfaces of two separate metal members each embedded in the plastics body.

Figure 7:
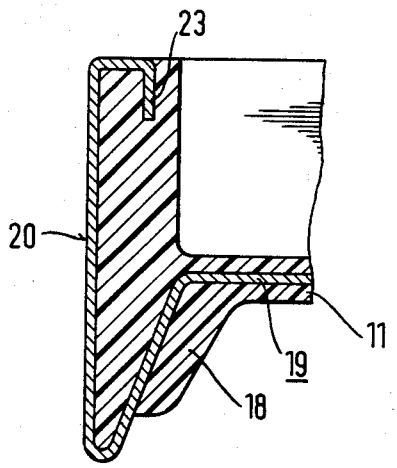
FIG. 7 is a sectional side elevation showing a third embodiment of the invention.

To afford a reliable bond to the plastics material a number of voids 22 may be provided in first surface 20 and other region of the metal member 19 to allow the plastics material to form a locking section thus holding the metal member in proper position when the tool is in use. An alternate embedding method is shown in FIG. 7 where the metal is folded over to form a hook 23 for retaining the surface 20 in the proper position. The longitudinal portion of the metal member embedded in the base strengthens the base 11. Therefore the plastics material can be made thinner than if the base 11 was completely made of plastic, although this may be expedient where even greater weight-saving is desired.

Figure 4:
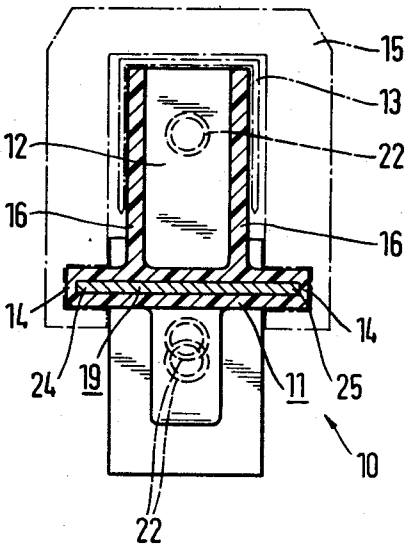
FIG. 4 is a sectional end view along line B—B of FIG. 3.

As best shown in FIG. 4, to further strengthen the bench, the metal portion embedded in the base may also extend into the web 14 section that is used for mounting in the guideway in the tool. The metal extensions 24 may be full length as in FIG. 2A or only short segments 25 located where maximum strength is needed as shown in FIG. 2B.

Figure 5:
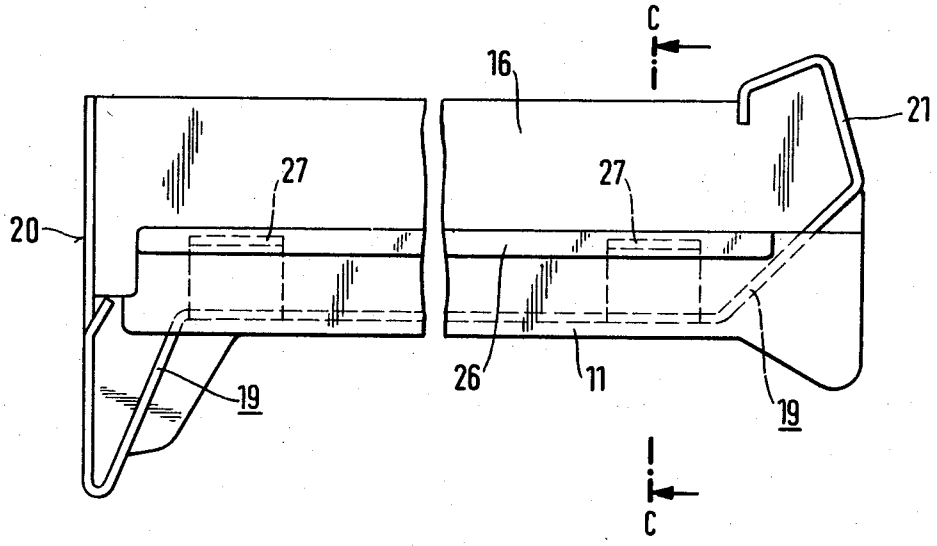
FIG. 5 is a side elevational view of a bench according to a second embodiment of the invention.
Figure 6:
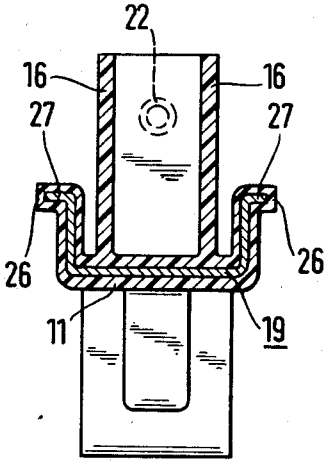
FIG. 6 is a sectional end view along the line C—C of FIG. 5.

FIGS. 5 and 6 show a guide bench where the guide webs 26 are spaced a vertical distance above the base 11. This design is wholly dependent on the guideway in the tool with which the bench 10 is to be used and is shown as an example only. It could differ considerably with different tools. The metal extensions 27 are formed vertically from the base 11 and then folded horizontally to reinforce the webs 26. Again the extensions 27 may be full length or shorter segments.

Figure 9:
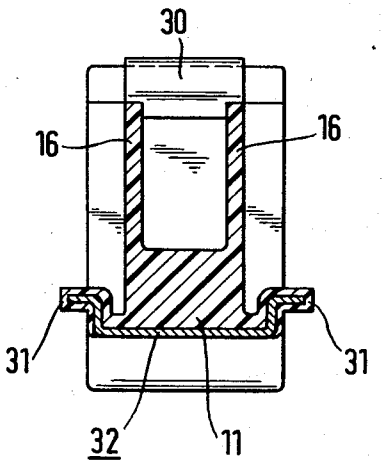
FIG. 9 is a sectional end view along line D—D of FIG. 8.
Figure 8:
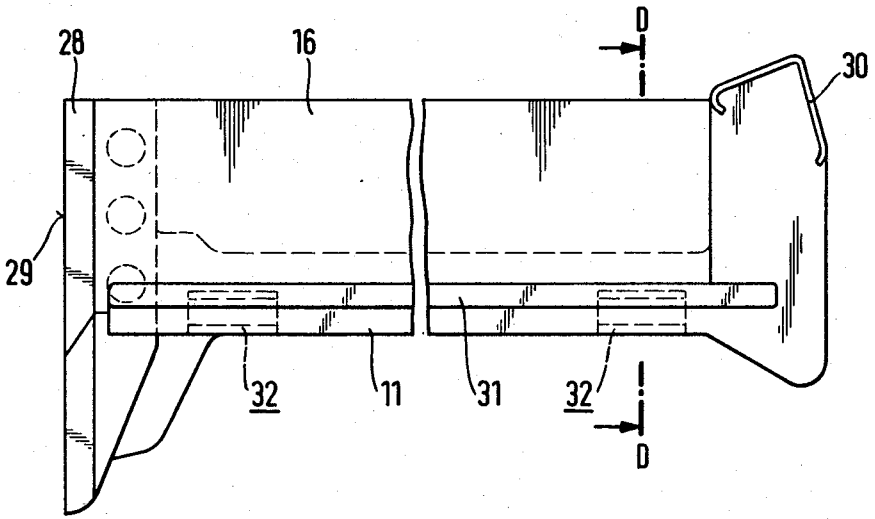
FIG. 8 is a side elevational view of a fourth embodiment of the invention.

Referring now to FIGS. 8 and 9, an alternative construction is shown. An insert 28 is embedded in the plastics material with the front surface 29 forming a wall portion of the ejection runway. A metal wearresistant shield 30 is placed over the plastics material where the bench retaining means would normally contact the bench. The shield 30 can be replaced as wear occurs thus extending the usefulness of the bench.

To further strengthen the web portion 31, a metal insert 32 may be embedded in the bench. In some tools these inserts 32 will not be needed when the forces are low enough for the plastics material to withstand such forces without breakage.

The shape and location of the insert 32 are dependent on the configuration of the mounting webs 31 and the base 11.

Figure 10:
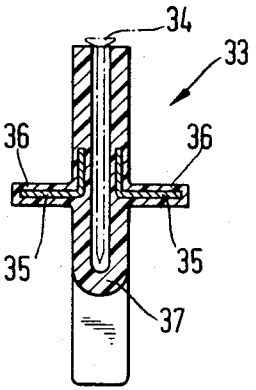
FIG. 10 is a sectional end view showing an embodiment of the guide bench according to the invention adapted for pins or nails.

FIG. 10 shows a cross-section through a bench 33 constructed for supporting and guiding nail or pin type fasteners 34. The metal insert 35 in this case may comprise separate sections on each side or continue from one web 36 through the base 37 and into the web on the other side. Again the shape shown is by example only and may differ depending on the fastener and tool.

Figure 11:
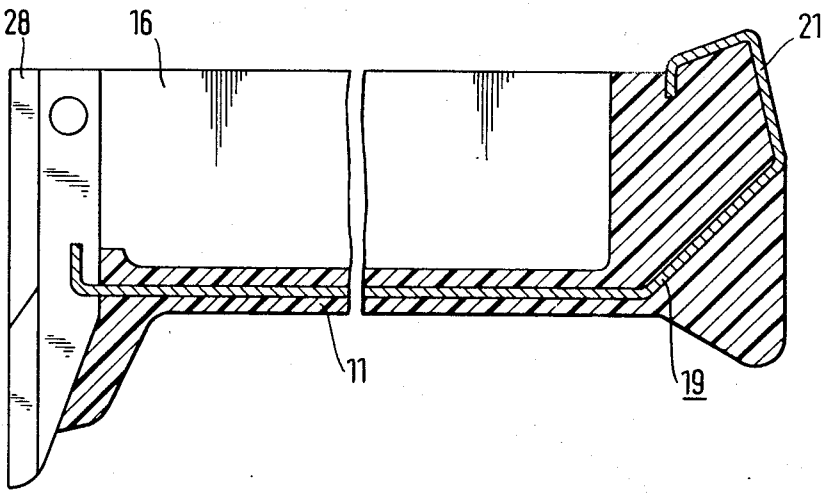
FIG. 11 is a side elevational view of a further embodiment of the invention having a different insert construction.

FIG. 11 shows a bench where the front insert 28 is the same as described in FIG. 8, where additional strength is needed in the ejection runway area. The insert containing the portion 21 for contacting the bench retaining means is the same as described in FIG. 5. For locating purposes the two inserts may be interlocked prior to being embedded in the plastics material.

Figure 12:
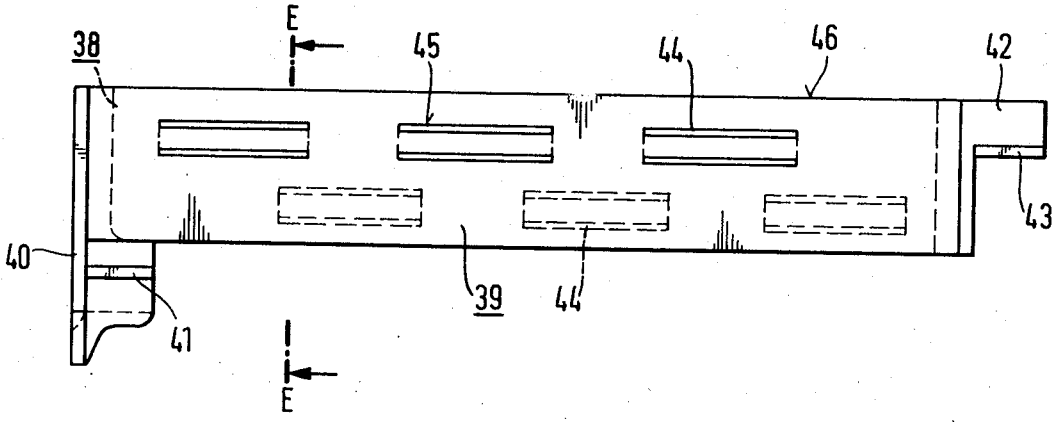
FIG. 12 is a side elevational view of a further embodiment of the invention.
Figure 13:
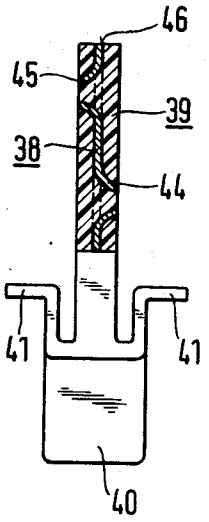
FIG. 13 is a sectional end view along line E—E of FIG. 12.

Referring now to FIGS. 12 and 13, a guide bench is shown that is used in tools utilizing staples having long leg portions compared to the crown. To reduce weight yet provide strength and wear-resistant characteristics a metal insert 38 is embedded within the center portion 39. A front insert 40 is constructed to provide mounting webs 41 for the purpose of supporting the bench near the front where the downward thrust of a staple driver is greatest. The webs 41 are disposed in slots adapted for that purpose on the tool. The opposite end of the bench has a bench retaining insert 42 with webs 43 adapted for mating with matching slots on the tool.

The center section 39 is constructed from a plastics material with external size to match that of the staple being used. The metal insert 38 has protrusions 44 within the insert 38 for the purpose of allowing the plastics material 39 to form a secure bond. The outside edges 45 of the protrusions 44 serve as a wear-resistant surface for the staples to ride against. The top 46 of the insert 38 also serves as a wear-resistant surface against the under side of the staple. The insert 38 may be a separate insert or be part of a single insert when the front insert 40 and rear insert 42 are combined prior to molding with the plastics material 39. Although the protrusions 44 are shown rectangular, the size and shape may vary depending on the configuration of the insert 38 and the plastics portion 39.

What is claimed is:

1. A guide bench for guiding fastener elements to be driven along an ejection runway by fastener guiding apparatus, the bench comprising a guide section for guiding fastener elements to said ejection runway and a retaining portion for contact by retaining means in said apparatus, wherein:

a major portion of the bench is of synthetic plastics material;

first and second metal portions are embedded in said plastics material;

a surface of said first metal portion is exposed and shaped to form a wall of said ejection runway; and a surface of said second metal portion is exposed and forms said retaining portion;

wherein at least one of said metal portions has an angularly bent section re-entering said plastics material.

2. A fastener driving tool comprising a guide bench for guiding fastener elements to be driven along an ejection runway by fastener driving apparatus and guide bench retaining means wherein said guide bench comprises a guide section for guiding fastener elements to said ejection runway and a retaining portion disposed in contact with said retaining means, a major portion of the bench being of synthetic plastics material, first and second integral metal portions embedded in said plastics material with a surface of said first metal portion being exposed and shaped to form a wall of said ejection runway and a surface of said second metal portion forming said retaining portion.

3. A guide bench for guiding fastener elements to be driven along an ejection runway by fastener driving apparatus, the bench comprising a guide section for guiding fastener elements to said ejection runway and a retaining portion for contact by retaining means in said apparatus, wherein:

a major portion of the bench is of synthetic plastics material; first and second integral metal portions are embedded in the plastics material, a surface of said first metal portion is exposed and shaped to form a wall of said ejection runway; and a surface of said second metal portion reinforces said retaining portion.

4. A guide bench for guiding fastener elements to be driven along an ejection runway by fastener driving apparatus, the bench comprising a guide section for guiding fastener elements to said ejection runway and a retaining portion for contact by retaining means in said apparatus, wherein:

a major portion of the bench is of synthetic plastics material;

first and second integral metal portions are embedded in said plastics material;

a surface of said first metal portion is exposed and shaped to form a wall of said ejection runway; and a surface of said second metal portion forms said retaining portion.

5. A bench according to claim 4 wherein at least one of the metal portions has at least one aperture embedded in said plastics material.

6. A guide bench for guiding fastener elements to be driven along an ejection runway by fastener driving apparatus, the bench comprising a guide section for guiding fastener elements to said ejection runway and a retaining portion for contact by retaining means in said apparatus, wherein;

a major portion of the bench is of synthetic plastics material;

first and second metal portions are embedded in said plastics material;

a surface of said first metal portion is exposed and shaped to form a wall of said ejection runway;

a surface of said second metal portion forms said retaining portion; and a further metal portion extending longitudinally of said guide section.

7. A bench according to claim 6, wherein said guide section has a lateral guide flange and said further metal portion extends within said flange.

8. A bench according to claim 6 wherein said further metal portion extends substantially the length of said guide section.

9. a bench according to claim 6 wherein said further metal portion is integral with at least one of said first and second metal portions.

10. A bench according to claim 6 wherein said further metal portion has at least one protrusion forming an anchoring surface.

11. A bench according to claim 10 wherein an edge of said further metal portion is exposed as a wear-resistant surface.

12. A bench according to claim 11 wherein the or each protrusion forms a wear-resistant exposed surface.

* * * * *